United States Patent [19]

Negri

[11] 3,937,040

[45] Feb. 10, 1976

[54] METHOD OF KNITTING PANTY HOSE

[75] Inventor: Ettore Negri, Florence, Italy

[73] Assignee: Billi S.p.A., Florence, Italy

[22] Filed: Apr. 4, 1974

[21] Appl. No.: 458,024

[30] Foreign Application Priority Data

Apr. 5, 1973 Italy ..... 9405/73

[52] U.S. Cl. ..... 66/177

[51] Int. Cl.[2] ..... A41B 9/02

[58] Field of Search ... 66/175, 176, 177; 66/172. E

[56] References Cited

UNITED STATES PATENTS

| | | | |
|---|---|---|---|
| 2,962,884 | 12/1960 | Garrou et al. | 66/177 |
| 3,075,375 | 1/1963 | Garrou et al. | 66/177 |
| 3,109,300 | 11/1963 | Garrou et al. | 66/177 |
| 3,109,301 | 11/1963 | Garrou et al. | 66/177 |
| 3,748,870 | 7/1973 | Fregeolle | 66/177 |
| 3,802,229 | 4/1974 | Fregeolle | 66/177 |

*Primary Examiner*—W. C. Reynolds
*Assistant Examiner*—Andrew M. Falik
*Attorney, Agent, or Firm*—Clifton T. Hunt, Jr.

[57] ABSTRACT

A process for knitting the body portion of a panty or panty hose of one piece construction on a circular knitting machine which comprises knitting a first leg portion by tubular knitting, supporting the tubular knit portion on all the needles while inactivating the needles along a first arc and knitting by reciprocal motion on a second arc of needles to form a first waist portion, casting off the fabric from said second arc of needles, activating the needles along said first arc of needles and knitting by reciprocatory motion to form a crotch panel, inactivating said first arc of needles while supporting the crotch panel thereon, knitting a second waist panel on said second arc of needles, and then knitting on all the needles in a circular motion to form the remainder of the body portion. The dimensions of the waist panels and the dimension of the crotch panel may be changed as desired by varying the number of wales and courses in each panel according to the desired size of the completed garment.

2 Claims, 20 Drawing Figures

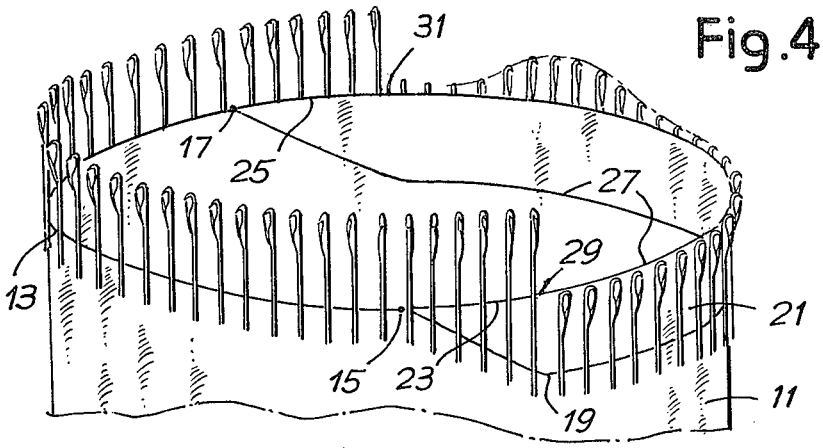
Fig.4
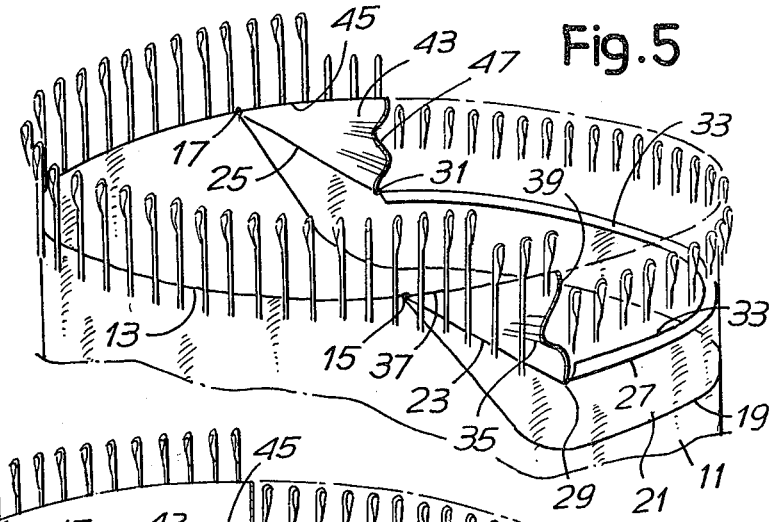
Fig.5
Fig.6
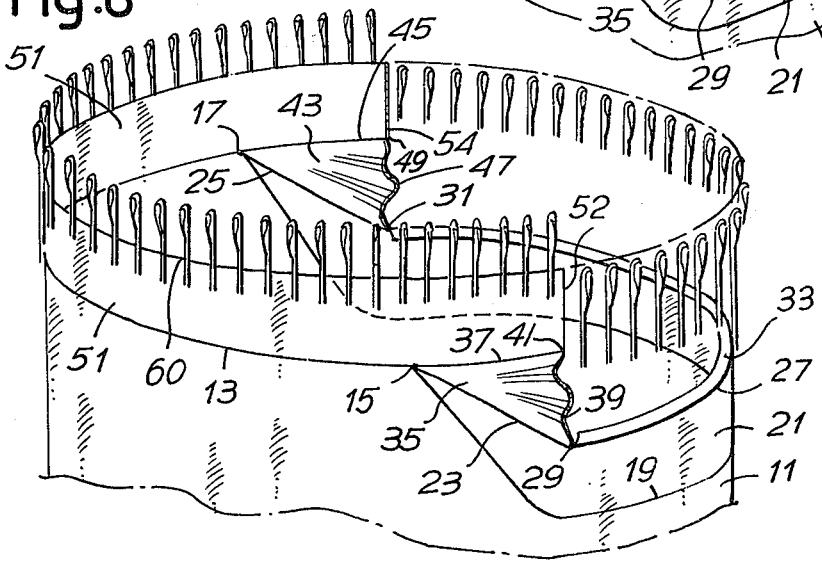

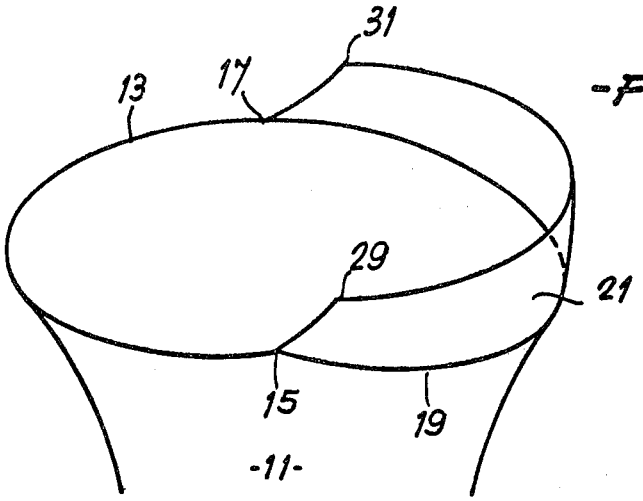
-FIG. 4A-
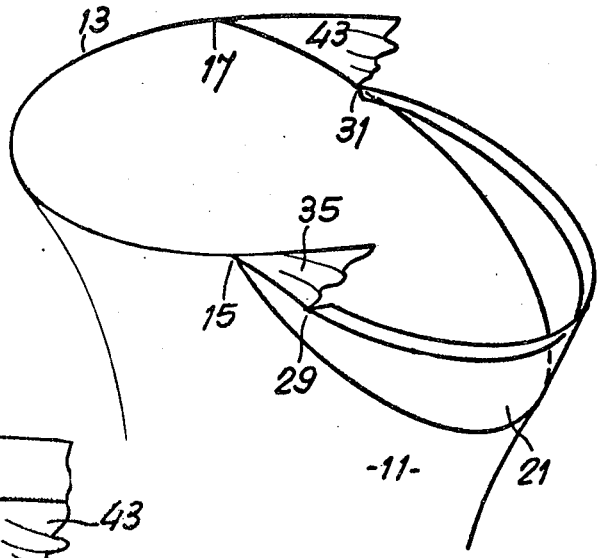
-FIG. 5A-
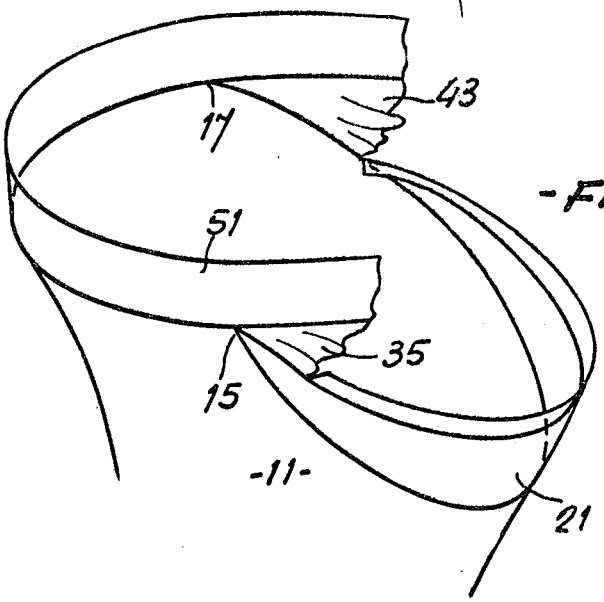
-FIG. 6A-

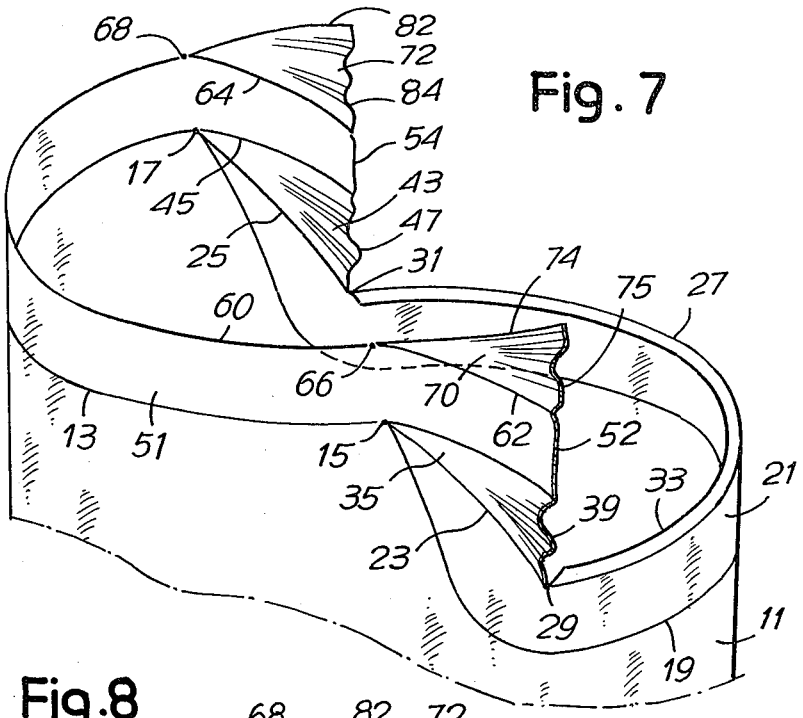
Fig. 7
Fig. 8
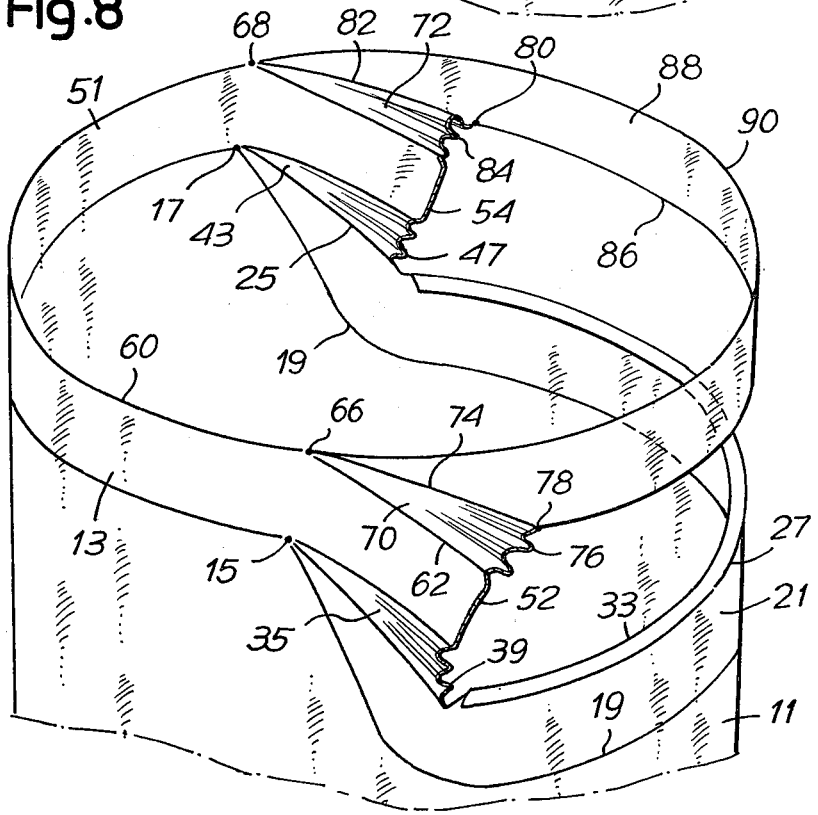

- FIG. 12A -
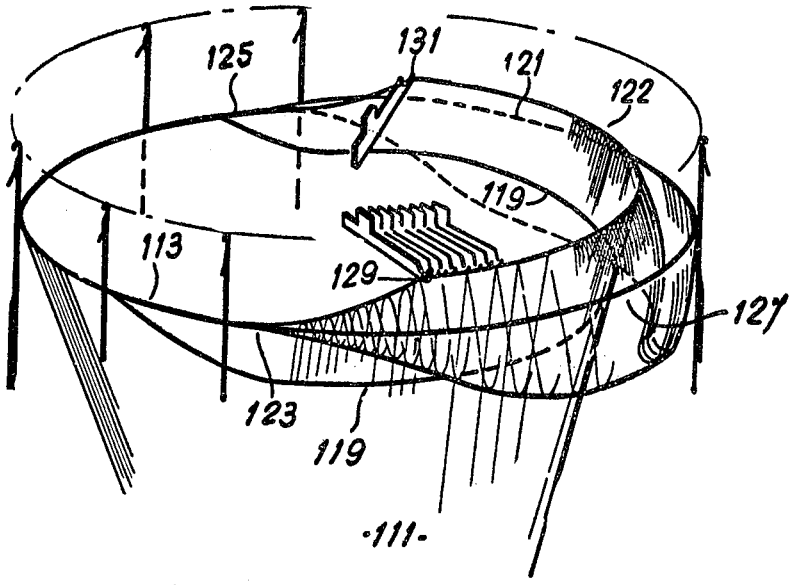
- FIG. 12B -
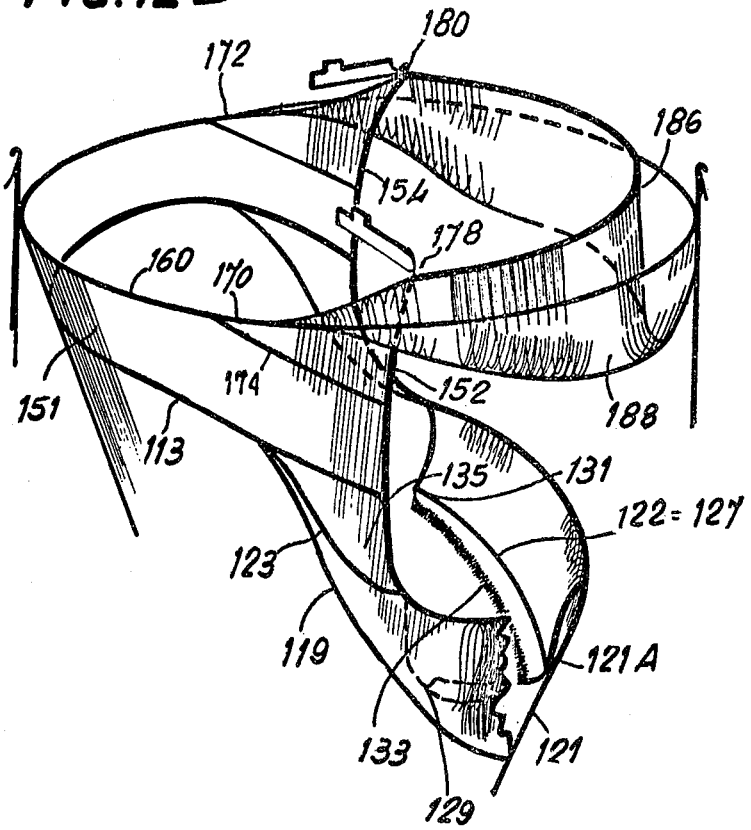

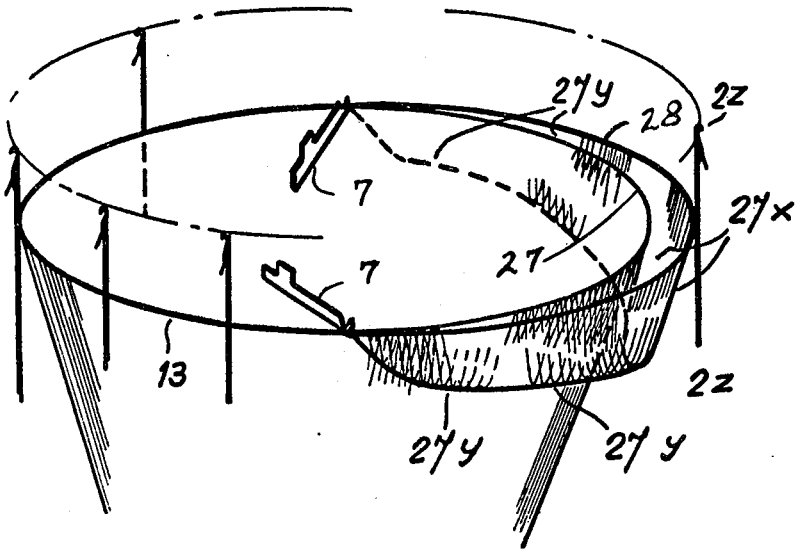
- FIG. 13A -

METHOD OF KNITTING PANTY HOSE

BACKGROUND OF INVENTION

It is known to make panty hose, for example, of one piece construction on a circular knitting machine but difficulty has been encountered in providing a body portion of a comfortable fit, particularly in the larger sizes. Circular knitting machines usually have a needle cylinder of about four inches in diameter and the practice of knitting a one-piece panty hose generally consists of beginning with the toe portion of one leg and knitting by circular knitting the first leg portion, the body portion, and the second leg portion in succession. Consequently, the size of the body portion is predetermined by the diameter of the needle cylinder. An example of the one-piece panty hose of the type described is shown in U.S. Pat. No. 3,673,821 to Johnson.

SUMMARY OF INVENTION

The invention is illustrated and described in the environment of a one-piece panty hose or one-piece tights including a first leg portion, a body portion and a second leg portion, but the subject matter of the invention resides in the forming by reciprocal knitting panels of the body portion of said panty hose or tights.

In the illustrated embodiment, the one-piece panty hose is started by knitting the toe of a first leg portion, the toe being either a closed toe of the type, for example, as shown in Currier Pat. No. Re 26,580 or in Micheletti Italian Pat. Nos. 814,164 and 837,903, or an open toe which may be subsequently seamed after the knitting of the one-piece panty hose is completed and the garment removed from the machine. After knitting of the toe portion is completed, the first leg portion is knit on all the needles by continuous circular knitting in a conventional manner until the first leg portion is completed and the next step is to knit the body portion. A first arc of the terminal course of the first leg portion corresponds to the initial course of the crotch of the body portion.

Said first arc of the terminal course of the first leg portion is supported on an arc of needles comprising, for example, about one-half the needles of the machine. Reciprocatory knitting is begun on the remaining active needles to form a first panel of the body portion. Thereafter, successive panels of the body portion are formed by reciprocatory knitting on selected needles until the body portion is completed. Each of the several panels which define the body portion, or the panty in the event it is desired to knit only the body portion without legs, may be of desired dimensions, both course-wise and wale-wise depending upon the pattern of the machine for selecting the needles. Accordingly, the concept of defining successive panels of differing desired dimensions enables the making of the body portion with a proportional fit to thereby provide a more comfortably fit garment than has heretofore been possible on a circular knitting machine.

After the body portion is completed, knitting is continued on all the needles by conventional circular knitting to form the second leg and its toe portion, which also may be knit either closed or open as described in connection with the toe portion of the first leg.

OBJECTS OF INVENTION

The primary object of the invention is to provide a more comfortably fitting garment by circular knitting than has heretofore been possible and the method of needle selection which makes possible the knitting of such a garment.

It is a more specific object of the invention to provide a pattern of needle selection in a circular knitting machine wherein the needle selection is varied in each of a sequence of panels to produce a garment having a plurality of variously dimensioned panels which combine to form a better fitting garment than has heretofore been possible on a circular knitting machine. It will be understood that although the invention is described and illustrated as comprising a plurality of panels joined together at their common edges, the lines of demarcation are not visible in the completed garment.

BRIEF DESCRIPTION OF DRAWINGS

Some of the objects of the invention having been stated, other objects will appear to those skilled in the art as the description proceeds when taken in conjunction with the accompanying drawings in which:

FIGS. 4, 5, 6, 7 and 8 are prespective views schematically illustrating the sequence of knitting to form the several panels of the body portion according to the embodiment of FIG. 2;

FIGS. 4A, 5A, and 6A are views similar to FIGS. 4, 5, and 6 but more specifically illustrating the distortions which occur to the fabric when loops on inactive needles are picked up.

FIGS. 12A and 12B are schematic illustrations of stages of forming the tubular sheath of the second embodiment;

FIG. 13A is a view similar to FIG. 12B but illustrating the tubular sheath of the third form of invention;

DETAILED DESCRIPTION OF THE INVENTION

Figure 1:
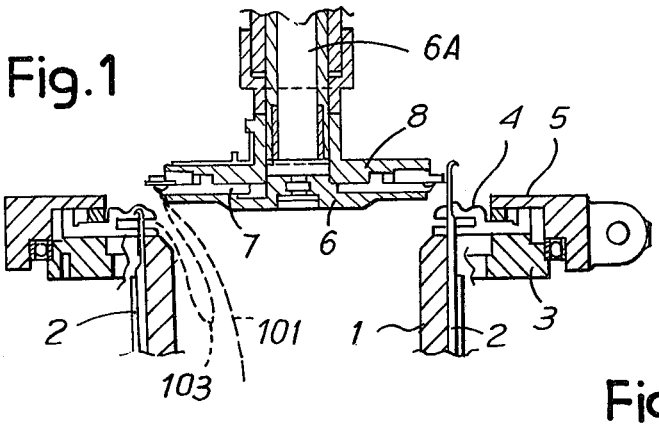
FIG. 1 is a fragmentary vertical sectional view of a portion of a circular knitting machine illustrating some of the components used in carrying out the method and making the resulting article of the invention.

Referring to FIG. 1, there is shown a partial representation of a circular knitting machine including a needle cylinder 1 around which are mounted for vertical reciprocation, a plurality of knitting needles 2. Cooperating sinkers 4 reciprocate radially in an annular structure or sinker cap 3 surrounding the needle cylinder. Reciprocal radial movement is imparted to the sinkers 4 by an annular element or cam ring 5 surrounding the sinker cap 3. A dial 6 is rotated by a shaft **6*a* in synchronization with the rotation of the needle cylinder 1 and the dial 6 carries a plurality of radially reciprocable hooks 7 which are actuated by cams 8.** The needle cylinder and its associated elements above described are of the conventional type and are used in a known manner to activate selected needles according to the sequence of the invention. The invention is not concerned with the means for knitting the fabric but is concerned with the sequence of needle selection for knitting the fabric.

Referring now to the first embodiment illustrated in FIGS. 2 through 8, there is indicated at 11 the upper part of a first leg portion formed by conventional circular knitting in the direction of the upwardly pointing arrow, it being understood that the toe and lower leg portion of the tubular fabric 11, although not shown, have already been knit. The tubular fabric 11 was knit on all the needles and its upper terminal course is defined by the lines 13 and 19.

Figure 3:
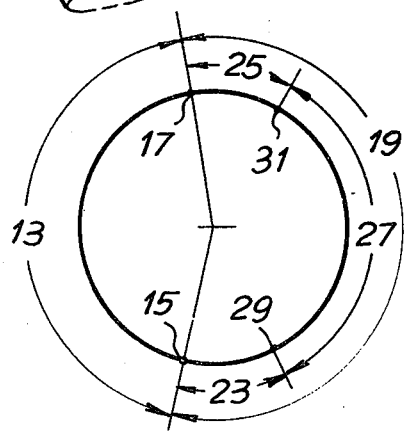
FIG. 3 is a schematic illustration of the arcs of the needles which knit designated panels of the body portion according to the embodiment of FIG. 2.
Figure 9:
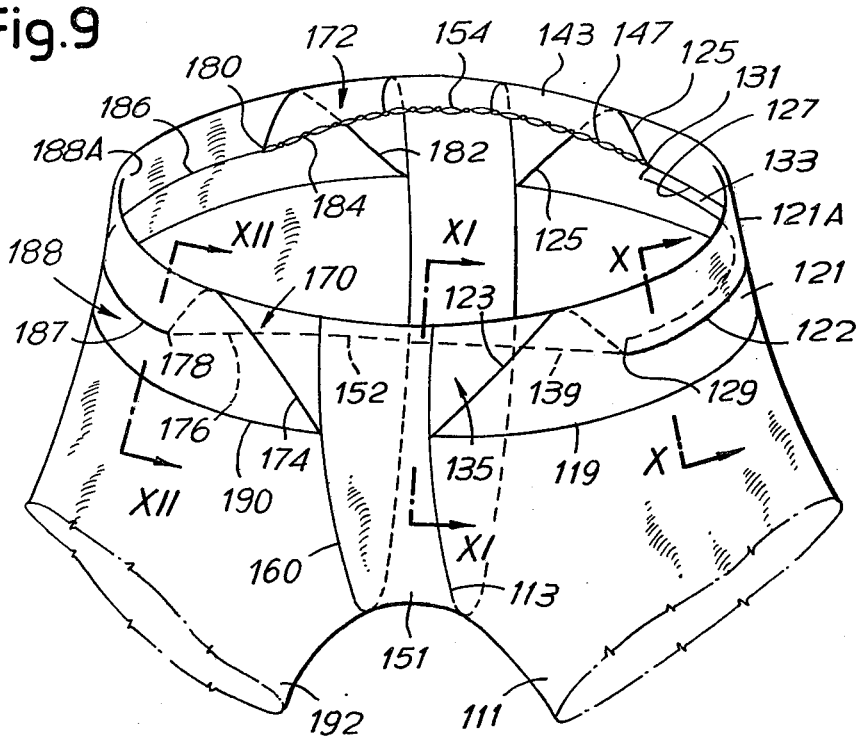
FIG. 9 is a view similar to FIG. 2 but illustrating a second embodiment of the invention.

After knitting the terminal course of the tubular fabric 11 defined by the lines 13 and 19, with a continuous circular motion, the needles corresponding to an arc 13 (FIGS. 3 and 4) of the needle circumference between the points 15 and 17 in FIGS. 3 and 4, are inactivated by raising the needles and retaining on them said terminal course 13. The needles along the arc 19 of the needle cylinder in FIGS. 3 and 4 continue knitting the fabric with a reciprocal motion to form a first panel or flap of fabric 21.

The panel 21 is of trapezoidal configuration and is formed with a progressive decrease of the needles along the arc 19 between the points 15 and 17, successively inactivating additional needles adjacent the points 15 and 17 by raising the needles to be inactivated, thereby tapering the ends of the panel 21 along the lines 23 and 25 extending respectively from the points 15 and 17. The panel 21 is knit in the direction of the arrow F-5 in FIG. 2 from the terminal course 19 to an edge 27 extending between points 29 and 31 at which the tapered ends denoted by the lines 23 and 25 (FIG. 2) of the panel 21 terminate.

Figure 2:
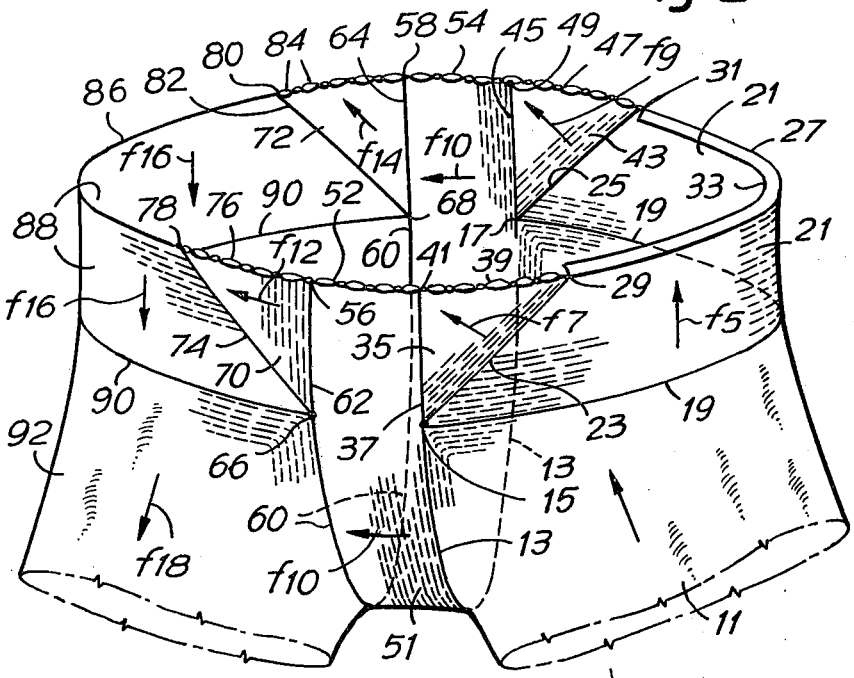
FIG. 2 is a perspective view of a one-piece panty hose, according to a first embodiment of the invention, removed from the machine and with parts of the legs broken away and illustrating the sequence of forming by reciprocal knitting the several panels which define the body portion.

After reaching the terminal course 27 of panel 21, reciprocatory knitting continues between the points 29 and 31 to form an anti-ravel tab 33 which serves as a finish of a portion of the waistband defined by the panel 21 in the embodiment of FIG. 2.

At the end of the forming of the tab 33 along the edge 27 of panel 21, the needles along the arc extending between points 29 and 31 are raised out of operation and reciprocatory knitting continues on the needles extending between the points 15 and 29 along the line 23 and in the direction of the arrow F-7 in FIG. 2 to form a second panel 35 of triangular configuration. The needles between the points 15–19 and –31 are put into action at this point. The triangular shape of panel 35 is achieved by gradually reducing the operational needles along the line 23 departing from the point 15 toward the point 29 as shown in FIG. 4. The edges of the triangular panel 35 are indicated at 37 and 39 in FIGS. 2, 5 and 6 and the triangular panel 35 is formed by retaining the stitches onto needles gradually excluded from knitting between the points 15 and 29 in FIG. 4. The edge 39 is developed like a chain by the same needle which corresponds to the point 29. The edges 37 and 39 converge to an apex 41 which along the needle bank also corresponds to the needle at point 29.

A third panel 43 is similarly formed in triangular configuration between the points 17 and 31 along the line 25 in FIGS. 2 and 4 and is knit in the direction of the arrow F-9 in FIG. 2. As in panel 35, panel 43 is formed by knitting with a reciprocatory motion and with courses gradually reducing with the progressive inactivating of the needles starting from the point 17 in the case of panel 43. The panel 43 is defined by an edge 45 which remains engaged to the needles gradually excluded from operation and by an edge 47 developed as a chain edge at the needle coinciding with the point 31. The edges 45 and 47 converge to an apex 49.

The two triangular panels 35 and 43 may be formed simultaneously by an appropriate increase in the amplitude of the reciprocating motion of the needle cylinder, and with the provision of an appropriate feed position of the yarn designed for each of the two triangular panels.

After the two triangular panels 35 and 43 are completed all of the needles along the circumference of needles are out of action. At this point a forming stage takes place for a fourth panel 51 knitted with a reciprocatory motion along the bank of needles constituted by the arc 13 and therebeyond on the needles which knit the edges 37 and 45 of panels 35 and 43, that is between the points 41 and 49 in FIG. 2. The needles which have previously knit the first panel 21 remain out of action during the reciprocatory knitting of said fourth panel 51. The panel 51 is of rectangular configuration and is made without increase of decrease of the needles while knitting with reciprocal motion in the direction of the arrow F-10 in FIG. 2. The panel 51 includes end edges 52 and 54, each defined as a selvage by respective needles at the points 29 and 31, it being thereby understood that the end edges 52 and 54 on panel 51 are continuations of the respective selvages 39 and 47 on the triangular panels 35 and 43. Thus, in FIG. 2 the points 29, 41 and 56 correspond to the same position, that is, to the same needle and the end edge 54 of panel 51 is in fact a continuation of the selvage 47 of triangular panel 43.

The panel 51 is defined in FIG. 2 beginning at the back with the selvage 54 and continuing toward the front from the point 49 along the lines 45, 13 and 37 to the selvage 52 and then back toward the rear from the point 56 along the lines 62, 60 and 64 to the point 58. Referring to FIG. 2, it will be observed that the length 60 corresponds to the length 13, the length 62 to the length 37, and the length 64 to the length 45. The points 56 and 58 indicate the limits of the length 62, 60 and 64, the point 66 corresponding to the point 15 on the needle cylinder as shown in FIGS. 7 and 8 and the point 68 corresponding to the point 17 on the needle cylinder as shown in FIGS. 7 and 8.

After completion of the course indicated by the line 60 between the points 66 and 68, the rectangular fourth panel 51 is completed and the needles along the arc 13 are inactivated and knitting continues along the line 62 in the direction of the arrow F-12 in FIG. 2 to knit a fifth panel 70 at the front of the garment Knitting is done with a reciprocal motion and with a reduction of active needles in a progressive manner from the point 66 toward the point 56 to form the fifth panel in a triangular configuration. An edge 74 of panel 70 is retained by the needles progressively withdrawn from action and a selvage 76 is formed between the point 56 and the apex 78 of the triangular panel 70. A sixth panel 72 at the rear of the garment may be formed simultaneously or subsequently by reciprocal knitting between the points 60 and 58 along the line 64 in the direction of the arrow F-14 in FIG. 2 and with a corresponding reduction of needles along line 82 to form the panel 72 in a triangular configuration. A selvage 84 extends from point 58 to the apex 80 of the triangular panel 72.

Upon completion of the triangular panels 70 and 72, all the needles about the circumference of the cylinder will be raised to their inactive position at least along the arc represented by the edges 74, 60 and 82 in FIG. 7 between the points 78 and 80 in FIG. 8 (which corresponds on the circumference of the needles to the points 29 and 31 in FIG. 4).

Reciprocal knitting is then commenced along the arc 86 in FIG. 8 between the points 78 and 80 and in the direction of the arrow F-16 in FIG. 2 to form a seventh panel 88. The panel 88 is of trapezoidal configuration and is knit on the same bank of needles as knit the panel 21. In the completed garment, the panel 88 is opposite the panel 21 with the triangular panels 35, 43, 70 and 72 and the ends of panel 51 extending therebetween to collectively define the waistband of the garment. The initial portion 86 of panel 88 in the completed garment will be seen as corresponding to the edge 27 of panel 21 with the selvages extending therebetween at the front and back of the garment. It is therefore desirable for the edge 86 to be finished in the same manner as the edge 27. The initial edge 86 of the panel 88 may be finished in the same manner as the edge 27 or may be initiated or finished with a simple flap or anti-ravel tab 33. The panel 88 is formed from courses of stitches which gradually increase in length by the progressive activation of needles starting from the point 78 and 80 as knitting continues in the direction of the arrow F-16. The needles which are progressively activated join the triangular panels 70 and 72 to the panel 88 along respective edges 74 and 82.

Upon completion of the seventh panel 88 at its terminal course 90, circular knitting is resumed along the edge 90 and beyond the points 66, 68 along the edge 60 of panel 51, the edge 60 having been previously kept suspended from its corresponding needles which have been kept in their raised inactive positions during knitting of the panel 88. The continuous circular knitting motion on all needles forms the tubular fabric 92 in the direction of the arrow F-18 (FIG. 2) to make the remainder of the body portion and the second leg portion.

The length of the needle arc defined by the points 15, 17 along the lines 13 and 19 may be desirably modified according to the size requirements which are to be imposed on the panty or the body portion of the garment being knit. The length of these knitting arcs will be determined in conjunction with the wale-wise dimension of the panels 21 and 88 as measured in the direction of the arrows F-5 and F-16 respectively; the wale-wise dimensions of the panel 51 measured according to the arrow F-10; and the widening or narrowing of the fabric according to the needle selection to progressively include and exclude needles from knitting during the forming of the panel 21 and the triangular panels 35, 43, 70 and 72 and the triangular end portions of the panel 88.

Thus, it is possible with the sequence of knitting operations described to make the various panels of any desired dimension and thereby obtain an efficient proportioning of the dimensions of the panty or body portion of the panty hose while knitting the article entirely on a circular knitting machine of a diameter suitable for knitting by continuous circular knitting the leg portions of a one-piece panty hose.

THE SECOND EMBODIMENT

According to the embodiment illustrated in FIGS. 9 through 12, a welt-like tubular sheath is provided at the waist portion of the garment. Otherwise, the embodiment shown in FIGS. 9 through 12 is substantially the same as the first described embodiment and like parts or elements in the embodiment illustrated in FIGS. 9 through 12 bear the same reference numbers as corresponding parts or elements in the embodiment of FIGS. 2 through 8, but increased by 100.

According to the embodiment of FIG. 2, the trapezoidal side panels 21 and 88 terminate with their respective upper edges 27, 33 and 86 being flattened and communicating directly with their respective panels 21 and 88. Consequently, the edge of the fabric in correspondence of the waistline in the embodiment of FIG. 2 is defined by the edge 27–33, by the edge 86 and by the chain edges 39—52—76 and 47—54—84. According to the embodiment of FIGS. 9 through 12, a tubular sheath is provided as an extension but integral with the side panels 21 and 88 and the intervening front panels 35, 51 and 70 and the intervening rear panels 43, 51 and 72. Partial tubular sheaths are formed on the side panels 21 and 88 by the well-known technique for forming the so-called double welt or the formation of a two-ply fabric by employing the dial 6 and its associated hooks 7.

Referring now to FIG. 1, it is there illustrated that an article 101 may be engaged to the dial hook 7 along the entire circumference of the dial or along any desired arc of its circumference. While the article 101 is engaged by the dial hooks 7, knitting may continue on the entire circumference of the knitting needles or along any desired arc of its circumference to form a pocket 103 extending between the dial hooks 7 and the cylinder needles 2. After the pocket has been knit to a desired dimension, the stitches retained by the dial hook 7 may be again engaged by the cylinder needles 2 to close the pocket and complete the welt for two-ply fabric as is well known by those skilled in the art.

By use of this will known technique, it is possible to provide a partial tubular sheath in correspondence of the panels 21 and 88 in FIG. 2.

Figure 10:
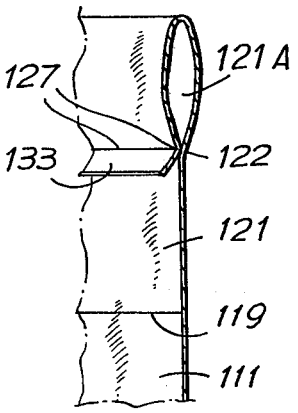
FIGS. 10, 11 and 12 are vertical sectional views taken substantially along the lines X—X, XI—XI, and XII—XII in FIG. 9.
Figure 11:
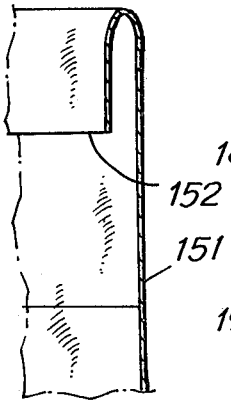

According to the embodiment of FIGS. 9 through 12, after having knit the portions of the tubular fabric 111 and after having started from the lines 119 to knit the trapezoidal side flap 121 with a reciprocating motion as has been more fully described in connection with the embodiment of FIGS. 2 through 8, the stitches of an intermediate partial course 122 from point 129 to point 131 of panel 121 are engaged to the dial hooks 7 which are in the corresponding arc of a conventional dial and reciprocal knitting continues to form a pocket fabric between the courses 122 and 127 as indicated at 103 in FIG. 1, until the terminal course 127 is reached. During the pocket knitting, the needles are gradually put out of action along the lines 123 and 125 until the arc of needles working is the same as 129–131. The course 127 is engaged to the fabric 121 along the line 122 with a stitch clearing operation from the dial hooks 7 to the needles 2. Thereafter, the anti-ravel tab 133 is formed as shown in FIG. 10.

Figure 12:
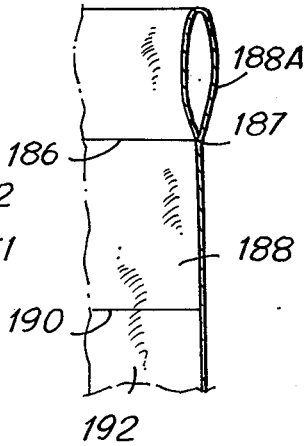

Then, in the manner already described in connection with the embodiment in FIGS. 2 through 8, the triangular panels 135 and 133 are knit and joined to the trapezoidal side panel 121 along the lines 123 and 125. The panel 151 is also knit in the manner previously described by reciprocal knitting along the arc 113 and joined to the corresponding sides of the triangular panels 135 and 143. The triangular panels 170 and 172 are also knit as previously described in connection with the embodiment of FIGS. 2 through 8. After having formed the apexes 178 and 180 of the triangular panels 170 and 172, a course 186 is knit as described in connection with the embodiment of FIGS. 2 through 8 and is transferred onto the same dial hooks 7 which had previously retained the panel 121 along the line 122. Reciprocal knitting then continues to form a first portion 188*a* of the trapezoidal side panel 188 thereby forming a pocket similar to the one indicated at 103 in FIG. 17 by gradually increasing the number of needles in action. After the pocket has been knit a desired length, the loops of the initial fabric are discharged from the dial hooks 7 to the knitting needles 2 to connect the initial edge 186 with the fabric 188 along the line 187 in an intermediate portion of the trapezoidal panel 188 as shown in FIG. 12 to thereby form an additional partial tubular sheath 188a corresponding to the tubular sheath 121*a*. Thereafter, reciprocal knitting of the trapezoidal side panel 188 continues to its terminal course 190. During the reciprocal knitting to form this panel 188*a*, 188, needles are progressively added to join the panel 188 with the edges 174 and 182 of the triangular panels 170 and 172. Next, circular knitting is resumed on all needles to form the tubular fabric 192 starting from the lines 190 and 160 in the same manner as previously described for knitting the tubular fabric 92.

The forming of the tubular sheath portions 121*a* and 188*a* has the practical effect of resulting in the portions of the triangular panels 135, 143, 170 and 172 adjacent their respective chained edges 139, 147, 176 and 184, and the end portions of the panel 151 adjacent its chain edges 152 and 154 all being turned inwardly and downwardly to join with the closure courses 122 and 187 of the side panels 121 and 188. Consequently, the inwardly and downwardly turned finished edges of the fabric at the waist opening in the embodiment of FIGS. 9 through 12 is located inside the waistband resulting in a more pleasing appearance.

The invention contemplates the possibility of providing for the insertion of an elastic band in said partial sheath 121a and 188a, or an elastic effect may be directly obtained by the use of elastic yarn in the knitting of the waistband portion.

The invention also contemplates that a waistband such as described in connection with FIGS. 9 through 12 may also be used in the embodiment of the invention to be subsequently described.

THE THIRD EMBODIMENT

Figure 13:
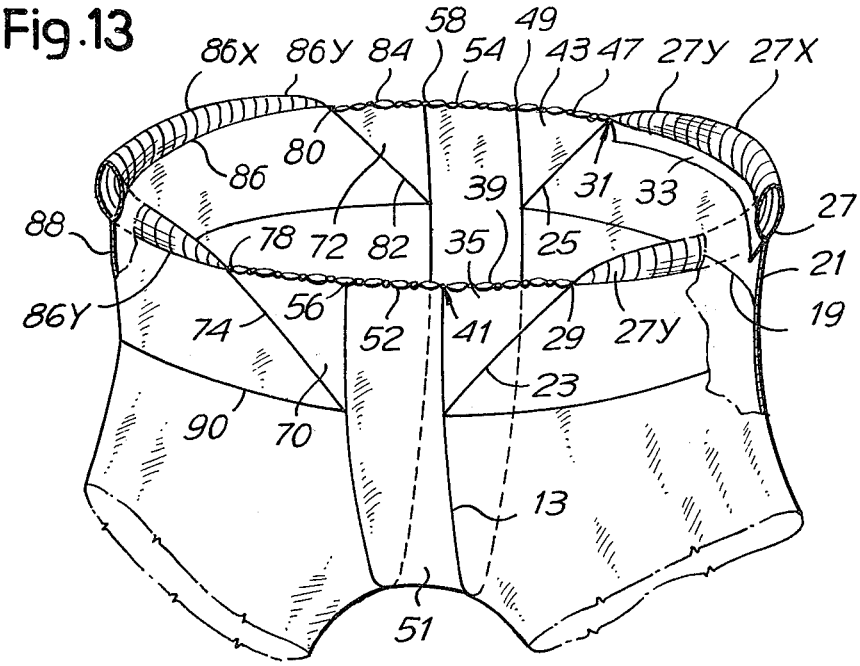
FIG. 13 is a view similar to FIG. 2 but partly in section and showing a third embodiment of the invention.

Another technique for finishing the waist portion of the garment is illustrated in FIG. 13. The remainder of the garment and its method of forming by sequentially knitted panels is substantially the same as the embodiment of FIG. 2 and the explanation of the embodiment of FIG. 13 will be restricted to that portion of the garment corresponding to the edges 27 and 86 in the embodiment of FIG. 2. The same reference symbols as used in the embodiment of FIG. 2 are used in illustrating like parts and like elements in the embodiment of FIG. 13.

According to the embodiment of FIG. 13, reciprocal knitting is carried out between the points 29 and 31 to form a tubular sheath having an intermediate zone indicated at 27X. The intermediate zone 27X is of uniform width throughout its length. Said intermediate zone 27X extends between end zones 27Y, each of which tapers from its juncture with the intermediate zone 27X toward its respective points 29 and 31 where the tubular sheath terminates. The tubular sheath 27X, 27Y is formed by the use of the dial hooks 7 and with reciprocatory knitting and with progressive increases and/or reductions of the active needles in the needle arc, the maximum width of the arc being that between the points 29 and 31 in correspondence of the line 27. The knitting sequence of forming the tubular sheath is illustrated in FIG. 13A, wherein 2Z denotes the needles which are the last to be excluded and the first to be put again into action during the knitting of the portions 27Y, 27X, and 27Y of the tubular sheath. For purposes of this invention, it is explained that the dial hooks 7 are extended along the arc defined by the points 29 and 31 in FIG. 13 in order to engage the fabric along the line 27. The yarn is seized by the hooks 7 projecting into the arc 29-31, and the fabric is thus suspended from the hooks 7 as shown in FIG. 13A. After this operation, reciprocal knitting is carried out initially along the arc 29–31 while the remaining needles are inactivated. The tapered portions 27Y at the ends of the tubular sheath 27Y; 27X, 27Y are formed by gradually decreasing the number of active needles along the arc 29–31. The terminal course 28 of the tubular sheath is engaged to the needles along the arc 29–31. At this point, the fabric engaged by the hooks 7 is brought back onto the needles and the edges 27 and 28 are connected between the points 29 and 31. A partial tubular welt is thus formed, after which reciprocal knitting continues to form a small anti-ravel tab 33. The forming of a finishing sheath of this kind is more fully described in applicant's copending application Ser. No. 458,027 filed concurrently herewith.

After the forming of the finishing sheath 27Y, 27X, 27Y, knitting continues as previously described to form the panels 35, 43, 51, 70 and 72. Next, a finishing sheath 86Y, 86X and 86Y is formed wherein the intermediate zone 86X has a uniform width throughout its extent and the terminal ends 86Y of the sheath taper from their respective junctures with the intermediate zone 86X toward their respective points 78 and 80 where the sheath terminates. The knitting of the sheath 86Y, 86X, 86Y is accomplished with the use of the dial hooks 7 and with the use of a reciprocal knitting motion and with the progressive increase and reduction of the active needles as has been described in connection with the formation of the sheath 27Y, 27X, 27Y. After the initial loops of the sheath 86Y, 86X, 86Y are transferred from the dial hooks to the needles, knitting proceeds in the manner previously described for the forming of the trapezoidal side panel 88.

The waistline is thus defined in two diametrically opposed and symmetrical zones by the tubular sheath 27Y, 27X, 27Y and 86Y, 86X, 86Y and with the intervening front chain edges 39, 52, 76 and the intervening rear chain edges 47, 54, 84.

THE FOURTH EMBODIMENT

Figure 14:
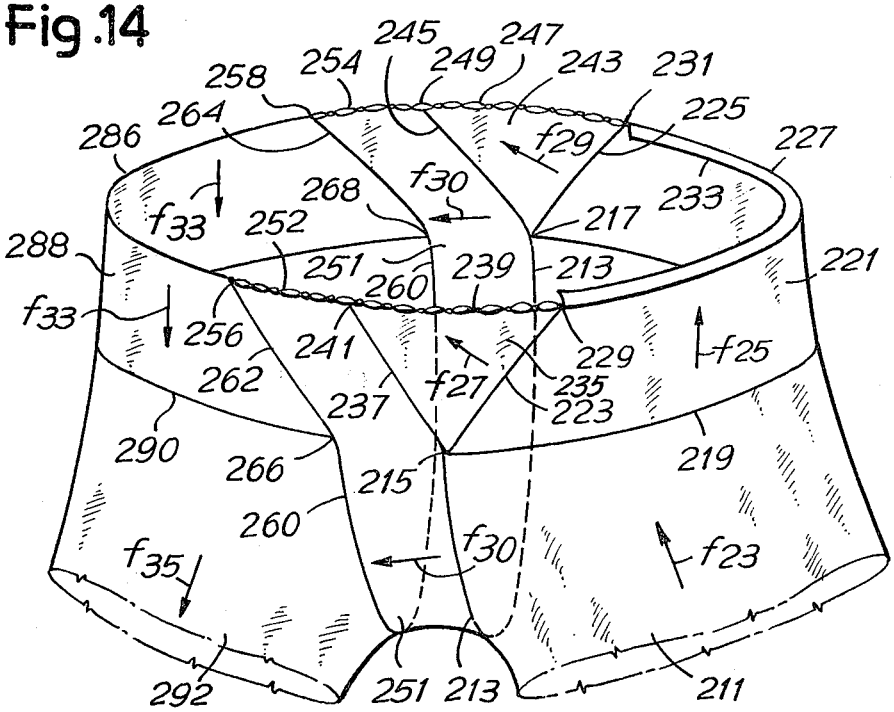
FIG. 14 is a view similar to FIG. 2 but showing a fourth embodiment of the invention.

The fourth embodiment, illustrated in FIG. 14, is like the first embodiment of FIG. 2 through 8 except that the triangularly shaped fifth and sixth panels 70 and 72 are omitted and the angular displacement of the triangularly shaped third panels 35 and 43 and the end portions of panel 51 are correspondingly altered. Like parts and elements in the embodiments of FIGS. 2 and 14 bear the same reference characters with 200 being added to the embodiment of FIG. 14.

The fourth embodiment eliminates the fifth and sixth panels in the first embodiment with a consequent relocation of the end portions of what was described in the first embodiment as rectangular fourth panel 51. The fourth embodiment is formed by continuous rotary knitting of the first leg until the line 213–219 is reached, where the bank of needles along the arc 213 is raised to inactive position and reciprocal knitting continues beginning along the line 219 in the direction of the arrow F-25 to knit the first panel 221. There is a gradual inactivation of needles at the ends of the panel 221 along the lines 223 and 225 to the point 229 and 231 to form a trapezoidal configuration. The second panel is completed at the line 227 and an anti-ravel tab 233 is knit to allow the fabric to be cast off from the needles along the arc 227. Any desired finish may be employed such as a tubular sheath as previously described and shown in FIG. 13, for example.

After forming of the anti-ravel tab 233 or other equivalent finish along the line 227, all needles are raised and out of operation along the arc formed by the lines 223, 213 and 225 between the points 229 and 231 and all the needles along the arc 227 between the points 229 and 231 are cleared. Now, knitting with a reciprocatory motion is commenced on the needles corresponding to the inclined edge 223 between the points 215 and 229 which have been relowered into operative positions to knit a second panel 235 in the direction of the arrow F-27. There is a gradual reduction of needles along the length 223 starting from the point 215 and proceeding toward the point 229 to form the second panel in triangular configuration. The triangular panel 235 is defined by an edge 237 along which the stitches are retained by the needles as they are gradually excluded by being raised. The triangular panel 235 is also defined by an edge 239 which is developed as a chain edge by the same needle which corresponds to the point 229. The edges 237 and 239 converge into an apex 241 which, corresponds on the needle bank to the same needle to which the point 229 also corresponds. A third panel 243, also of triangular configuration, is similarly formed starting along the inclined edge 225 between the points 217 and 231 and proceeding according to the arrow F-29 with the length of courses always decreasing with the progressive exclusion of needles starting from the point 217 toward the point 231. The triangular panel 243 is defined by an edge 243 along which stitches remain engaged to the needles which are gradually inactivated. The triangular panel 243 is also defined by an edge 247 developed as a chain edge. The edges 245 and 247 converge into an apex 249.

As in the first embodiment, the two triangular panels 235 and 243 may be formed simultaneously with an appropriate increase in the length of the arc of reciprocatory knitting and with a suitable feed position of the yarn for forming each of the two triangular panels.

At the completion of the said second and third panels 235 and 243, all the needles are out of operation. At this point, knitting is begun on the fourth panel 251 in a manner similar to the knitting of the panel 51 in the first embodiment. Panel 251 is formed by reciprocating motion along the arc 213 and along the arcs defined by the edges 237 and 245, that is between the points 241 and 249, while the remaining needles are inactivated and mostly raised. The fabric of the fourth panel 251 is formed in rectangular configuration by reciprocal knitting without increase or decrease of needles and proceeding in the direction of arrow F-30 and defining chain end edges 252 and 254. Knitting of the panel 251 is completed along the lines 262, 260, 264; the length 262 corresponding to the length 237, the length 260 corresponding to the length 213, and the length 264 corresponding to the length 245. The point 266 corresponds on the machine to the point 215 and the point 268 corresponds on the machine to the point 217.

At this point, all the needles are put out of action by raising them along the arc represented by the edges 262, 260, 264 between the points 256 and 258 (which correspond on the needle circumference to points 229 and 231).

A fifth panel 288 of trapezoidal configuration is started up in a conventional manner on the needles along the arc designated at 286 between the points 256 and 258, the length 286 representing an edge which in the completed article is symmetrical to the edge 227. The edge 286 is therefore finished with an edge or border corresponding to that with which the edge 227 is provided. If the edge 227 presents a simple anti-ravel tab 233 which is scarcely visible, the initial edge 286 may be started in a conventional manner without any particular border being provided. The panel 288 started on the edge 286 is formed in the direction of the arrow F-33 and with courses of stitches gradually increasing by the progressive activation of needles starting from the point 256 and 258. These progressively activated needles determining the stitch connection of the corresponding edges 262 and 264 to the panel 288. The panel 288 ends along the line 290 between the points 266 and 268 and in the completed garment the panel 288 lies opposite the side panel 221.

When panel 288 is completed along the line 290, knitting is resumed on all the needles with a continuous circular motion to form the tubular fabric 292 in the direction of the arrow F-35 to form the second leg of tubular fabric.

The sizing or dimensions of the several panels may be established according to criteria similar to those described with reference to the embodiment in FIGS. 2 through 8.

THE FIFTH EMBODIMENT

Figure 15:
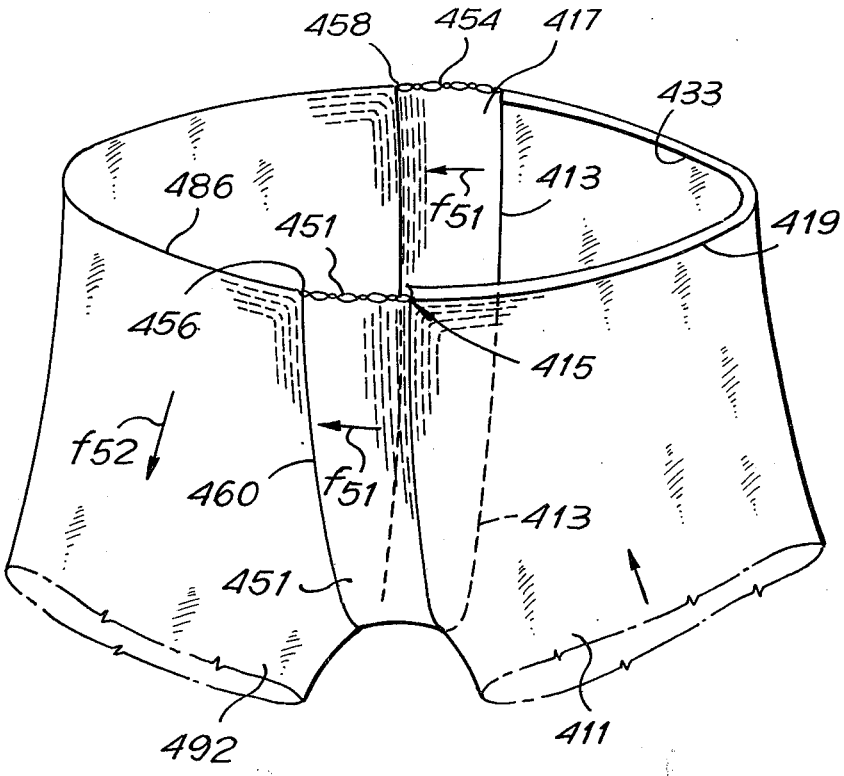
FIG. 15 is a view similar to FIG. 2 but showing a fifth embodiment of the invention.

FIG. 15 illustrates a fifth embodiment of the invention wherein the panty hose is formed as in the previous embodiment by knitting a toe portion and a first leg portion by conventional rotary knitting. Continuous rotary knitting of the first leg portion continues to form a first side panel of the body portion indicated at 411 in FIG. 15. The terminal course of the tubular rotary knit construction is indicated at 413 and 419 in FIG. 15. After having reached the lines 413 and 419, the needles corresponding to an arc along the line 413 between the points 415 and 417 are raised to an inactive position. The needles along the remaining arc 419 of the needle circumference are actuated in such a manner as to knit an anti-ravel tab of a known type, as indicated at 433, after which the needles are cleared of the fabric along the arc 419. If desired, the finished edge adjoining the terminal course 419 of the tubular fabric may be made in accordance with the tubular fabric finishes indicated in any one of the preceding embodiments, or otherwise as desired.

According to this fifth embodiment after the anti-ravel tab 433 is knit and the needles along the arc 419 are cleared, the needles along the arc 413 are moved to operative position and reciprocal knitting takes place along the arc 413 for the makeup courses of a panel 451 extending between the points 415 and 417. The panel 451 is of rectangular configuration and is made by reciprocal motion beginning between the points 415 and 417 and extending in the direction of the arrow F-51 for a predetermined number of courses. Chain edges 452 and 454 are formed between the point 415 and the point 456 and another chain edge is formed between the point 417 and the point 458. On the machine, the points 415 and 456 correspond to the same needle on one side of the machine and the points 417 and 458 correspond to the same needle on the other side of the machine. The rectangular panel 451 terminates in a course indicated at 460, the length of the course 460 corresponding to the length of the initial course 413 in panel 451.

At this point, the makeup courses of a new fabric on the needles along the arc 419, which have been cleared on the anti-ravel tab 433, is started to form the initial course 486 by reciprocal knitting between the points 456 and 458 (which ocrresponds to the points 415 and 417 on the needle circumference). The initial edge or makeup 486 will be furnished according to the same construction of the finish used for the course 419. Thereafter, knitting will be resumed on all needles with a circular motion along the arc 486 and beyond the points 456 and 458 along the arc 460, it being understood that the stitches in the terminal course of panel 451 have been retained on the needles. Continuous rotary knitting is continued to form the tubular fabric 492 defining a second side panel of the body portion and continuing through the second leg portion to its associated foot and toe portion.

The amplitude of the needle arc forming the panel 451 beginning along the arc 413, and the wale-wise length of the panel 451 (in the direction of the arrow F-51) will be proportioned according to the desired dimensional results.

Various modifications of the several embodiments of the invention will occur to those skilled in the art, all of which are within the scope of the invention as defined by the following claims:

What is claimed is:

1. A method of knitting the body portion of a panty or panty hose of one piece construction on a circular knitting machine, said panty or panty hose having first and second leg portions and waist portions, said method comprising:

a. knitting a first tubular knit leg portion by circular knitting, b. supporting the tubular knit portion on the knitting needles while inactivating the needles along a first arc, c. knitting by reciprocal motion on a second arc of needles to form a first waist panel, d. casting off the fabric from the second arc of needles, e. activating the needles along said first arc of needles and knitting by reciprocal motion along said first arc of needles to form a crotch panel, f. inactivating said first arc of needles while supporting the crotch panel thereon, g. knitting a second waist panel on said second arc of needles, and h. knitting on all the needles in a circular motion to form the second tubular knit leg portion.

2. A method according to claim 1 wherein a waist opening is formed transversely of the direction of knitting simultaneously with the knitting of said crotch panel.

* * * * *